United States Patent [19]

Hinz et al.

[11] 4,445,519

[45] May 1, 1984

[54] METHOD AND APPARATUS FOR JOINING COAXIAL ROD-SHAPED ARTICLES

[75] Inventors: Werner Hinz, Lauenburg; Gerhard Tolasch, Wentorf, both of Fed. Rep. of Germany

[73] Assignee: Hauni-Werke Körber & Co. KG., Hamburg, Fed. Rep. of Germany

[21] Appl. No.: 346,760

[22] Filed: Feb. 8, 1982

[30] Foreign Application Priority Data

Feb. 9, 1981 [DE] Fed. Rep. of Germany ..... 3104505

[51] Int. Cl.[3] ..... A24C 5/08; A24C 5/10

[52] U.S. Cl. ..... 131/94

[58] Field of Search ..... 131/94, 95, 88, 90, 131/92, 93, 71, 72, 280; 364/552; 493/43

[56] References Cited

U.S. PATENT DOCUMENTS

| | | | |
|---|---|---|---|
| 3,363,632 | 1/1968 | Gamberini | 131/94 |
| 3,527,234 | 9/1970 | Hinzmann | 131/94 |
| 4,044,779 | 8/1977 | Preston et al. | 131/94 |
| 4,077,415 | 3/1978 | Preston et al. | 131/94 |
| 4,191,198 | 3/1980 | Chopko | 131/88 |
| 4,236,535 | 12/1980 | Schmidt et al. | 131/94 |
| 4,237,907 | 12/1980 | Pawelko et al. | 131/94 |
| 4,262,680 | 11/1982 | Hinzmann | 131/94 |

*Primary Examiner*—Vincent Millin
*Assistant Examiner*—Harry Macey
*Attorney, Agent, or Firm*—Peter K. Kontler

[57] ABSTRACT

Groups of coaxial filter rod sections and plain cigarettes are delivered onto the peripheral surface of a rotary drum in such orientation that each group extends in parallelism with the axis of the drum and overlies the adhesive coated outer side of a discrete uniting band which adheres to the surface by suction and is formed on the drum in such a way that its leader overlies a groove in the surface. The cigarettes of each group are attracted to the drum by suction, and the sections of the groups are mechanically urged against the leaders of the respective bands by claws which are retractible into and extendable from the drum by one or more stationary cams, followers which track the cams and gears which receive motion from the followers and rotate discs having eccentric pins coupling them to the respective claws. The claws are disengaged from the respective sections, and the ports in the surface of the drums cease to attract the cigarettes and the bands before the groups reach a rolling gap wherein they rotate about their respective axes and convolute the bands around the respective sections and the adjacent end portions of the cigarettes. The claws prevent misorientation or separation of sections from the drum when the latter is driven at a high peripheral speed so that the sections tend to fly away under the action of gravity and/or centrifugal force.

20 Claims, 5 Drawing Figures

1
29
39
31
32
19
37
38
36
61
17
41
12
16
18
28
51
44
41
17
36
61
59
52
37
38
19
39
3
33
4
34

METHOD AND APPARATUS FOR JOINING COAXIAL ROD-SHAPED ARTICLES

BACKGROUND OF THE INVENTION

The present invention relates to a method and to an apparatus for establishing connections between neighboring rod-shaped articles by means of adhesive-coated uniting bands. More particularly, the invention relates to improvements in a method and in an apparatus for joining successive groups or arrays of at least two coaxial rod-shaped articles each by resorting to flexible patches of paper, imitation cork or like wrapping material, especially for assembling components of smokers' products.

It is known to assemble the constituents of filter cigarettes or analogous rod-shaped smokers' products on a rotary drum-shaped conveyor whose periphery receives a succession of discrete adhesive-coated uniting bands and groups of coaxial rod-shaped articles. The groups are attached to the respective uniting bands in such a way that they are in linear contact therewith during transport toward a so-called rolling gap wherein the groups are caused to rotate about their respective axes with the result that the corresponding uniting bands are convoluted therearound and are thereby converted into tubular connectors capable of holding the neighboring articles of a group against any movement relative to each other as well as of establishing fluidtight seals in the regions where the neighboring articles of a group abut against each other.

The rod-shaped articles which can be treated in accordance with the method and in the apparatus of the present invention can constitute or can form part of smokers' products. Typical examples of such articles are tobacco-containing plain cigarettes, cigarillos or cigars and filter rod sections of unit length or multiple unit length. For example, filter cigarettes are normally produced in so-called filter tipping machines wherein pairs of plain cigarettes of unit length are assembled with filter rod sections of double unit length preparatory to draping of adhesive-coated uniting bands around the filter rod sections and around the adjacent end portions of the plain cigarettes so that each of the resulting unitary rod-like bodies constitutes a filter cigarette of double unit length. Successive filter cigarettes of double unit length are thereupon severed midway across the filter rod sections so that each thereof yields two filter cigarettes of unit length. Typical examples of such filter tipping machines are those known as MAX and MAX S, produced by the assignee of the present application. Reference may be had, for example, to commonly owned U.S. Pat. No. 4,280,187 granted July 21, 1981 to Joachim Reuland et al. which illustrates a MAX S machine.

U.S. Pat. No. 3,470,884 granted Oct. 7, 1969 to McArthur discloses a portion of a filter tipping machine wherein a continuous web is subdivided into a series of spaced-apart uniting bands on a first drum-shaped conveyor, wherein successive uniting bands of such series are connected with groups of rod-shaped articles on a second drum-shaped conveyor, and wherein such groups (and the adhesive coated uniting bands which are in linear contact therewith) are transferred onto a drum-shaped rolling conveyor which transports the groups through a rolling gap defined in part by the concave surface of a stationary rolling member so that the groups are compelled to rotate about their respective axes and cause the associated uniting bands to be convoluted therearound. FIG. 2 of this patent shows that the uniting bands are convoluted around filter rod sections of double unit length and that the resulting filter cigarettes of double unit length are thereupon converted into filter cigarettes of unit length.

Commonly owned U.S. Pat. No. 3,527,234 granted Sept. 8, 1970 to Hinzmann discloses a similar filter tipping machine wherein the rolling gap is designed in such a way that each group of rod-shaped articles enters and leaves at least one flute at the periphery of the drum-shaped rolling conveyor. The patent to Hinzmann further discloses and illustrates the possibility of severing the web directly on the rolling conveyor and of applying discrete groups to successive uniting bands on the rolling conveyor upstream of the rolling gap.

During transport of groups of rod-shaped articles toward the rolling gap, the groups adhere to the respective uniting bands on the rolling conveyor exclusively as a result of linear or substantially linear contact between the articles of a group and the adhesive-coated side of the respective uniting band. In many instances, the path along which the groups of articles and the respective uniting bands advance on the rolling conveyor toward the rolling gap is relatively long; this should enable the adhesive to set (at least in part) and to thus prevent relative movement between the articles of a group and the respective uniting band. Such mode of transporting groups of coaxial rod-shaped articles and uniting bands toward the rolling gap is satisfactory as long as the speed of the rolling conveyor does not exceed a certain value at which the centrifugal force is sufficiently pronounced to effect a separation of rod-shaped articles from the uniting bands and/or separation of uniting bands (which are normally attracted by suction) from the periphery of the rolling conveyor. At the present time, filter tipping machines turn out up to and even in excess of one hundred cigarettes per second, i.e., approximately 6000 cigarettes per minute. The output of such machines is in the process of being greatly increased (the contemplated output is in the range of 10,000 cigarettes per minute). At such speeds, the conveyors which transport the constituents of filter cigarettes are incapable of preventing the constituents from flying away under the action of centrifugal force and/or of moving relative to each other with attendant reduction of quality of the ultimate products. Therefore, the speed of conveyors in existing filter tipping and analogous machines cannot be increased at will for the purpose of increasing the output to the aforementioned limit because this would entail the production of excessive numbers of rejects and would increase the frequency and duration of down times with attendant additional pronounced losses in output.

OBJECTS AND SUMMARY OF THE INVENTION

An object of the invention is to provide a novel and improved apparatus which can transport rod-shaped articles and adhesive-coated uniting bands in filter tipping or like machines at a speed greatly exceeding the speed of transport in existing machines but which is nevertheless capable of ensuring that the articles and uniting bands remain in their paths even though they are in mere or substantially linear adhesive contact with each other.

Another object of the invention is to provide an apparatus which can be installed in existing filter tipping and like machines to enable such machines to turn out much larger quantities of smokers' products per unit of time without in any way affecting the appearance and/or quality of such products.

A further object of the invention is to provide novel and improved means for transporting assemblies of groups of coaxial rod-shaped articles and uniting bands in a filter tipping or like machine.

An additional object of the invention is to provide the apparatus with novel and improved means for preventing relative movement between groups of coaxial rod-shaped articles and adhesive-coated uniting bands while such groups and the uniting bands are in the process of advancing toward a station where the bands are convoluted around the articles of the respective groups.

Still another object of the invention is to provide the apparatus with novel and improved means for biasing the articles of successive groups and the associated uniting bands against one another.

A further object of the invention is to provide a novel and improved method of preventing relative movement between articles which form part of groups of coaxial articles and adhesive-coated uniting bands in a filter tipping or like machine.

Another object of the invention is to provide a novel and improved method of holding rod-shaped articles and adhesive-coated uniting bands captive in their path during transport toward the station where the bands are convoluted around the respective articles.

An additional object of the invention is to provide a novel and improved method of preventing centrifugal force and/or gravity from changing the mutual positions of constituents of filter cigarettes or analogous rod-shaped articles on their way toward the station where the filter plugs are finally united with the respective tobacco-containing components.

Another object of the invention is to provide a relatively simple and inexpensive method of raising the output of filter tipping or like machines wherein rod-shaped articles are joined to each other by adhesive-coated uniting bands.

One feature of the invention resides in the provision of a method of joining groups of coaxial rod-shaped articles by means of adhesive-coated uniting bands at a rolling station, particularly of joining groups of articles which constitute or form part of smokers' products. For example, each group can consist of two coaxial plain cigarettes of unit length and a filter rod section of double unit length therebetween, and each uniting band may constitute a square or rectangular patch of cigarette paper, imitation cork or another suitable wrapping material which is dimensioned and applied to a group in such a way that it can be convoluted around the filter rod section as well as around the adjacent inner end portions of the respective plain cigarettes so that each group is converted into a filter cigarette of double unit length.

The method comprises the steps of subdividing a web of wrapping material (e.g., a continuous web of imitation cork or cigarette paper) into a series of discrete uniting bands, conveying the bands of the series in a predetermined direction and along a predetermined path (e.g., with the peripheral surface of a rotary drum-shaped rolling conveyor) toward the rolling station, contacting successive bands in the path by discrete groups of articles, biasing at least one article of each group against the respective band during transport toward the rolling station, and rolling successive groups about their respective axes at the rolling station so that the uniting bands are convoluted around the corresponding groups of articles.

As mentioned above, the path can be an arcuate path which is defined by the peripheral surface of a rotary drum-shaped rolling conveyor, and the rolling step preferably includes transporting the groups of articles and the associated uniting bands through a gap whose width is at least slightly less than the diameters of articles in a group so that the groups are compelled to roll about their respective axes during transport through the rolling gap.

The method preferably further comprises the step of confining the uniting bands to movement along the path and toward the rolling station independently of the biasing step. This can be achieved by pneumatically holding the uniting bands in the path, preferably by attracting the uniting bands into the path by suction.

To this end, the aforementioned peripheral surface of the drum-shaped rolling conveyor can be provided with suction ports which are connected with a suction generating device to attract the adjacent uniting bands during transport of such bands between the locus of their application to the peripheral surface and the aforementioned rolling gap.

The biasing step can include the step of mechanically urging some articles of the groups or entire groups of rod-shaped articles against the respective uniting bands in the path between the locus of application of groups of articles and the rolling gap.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
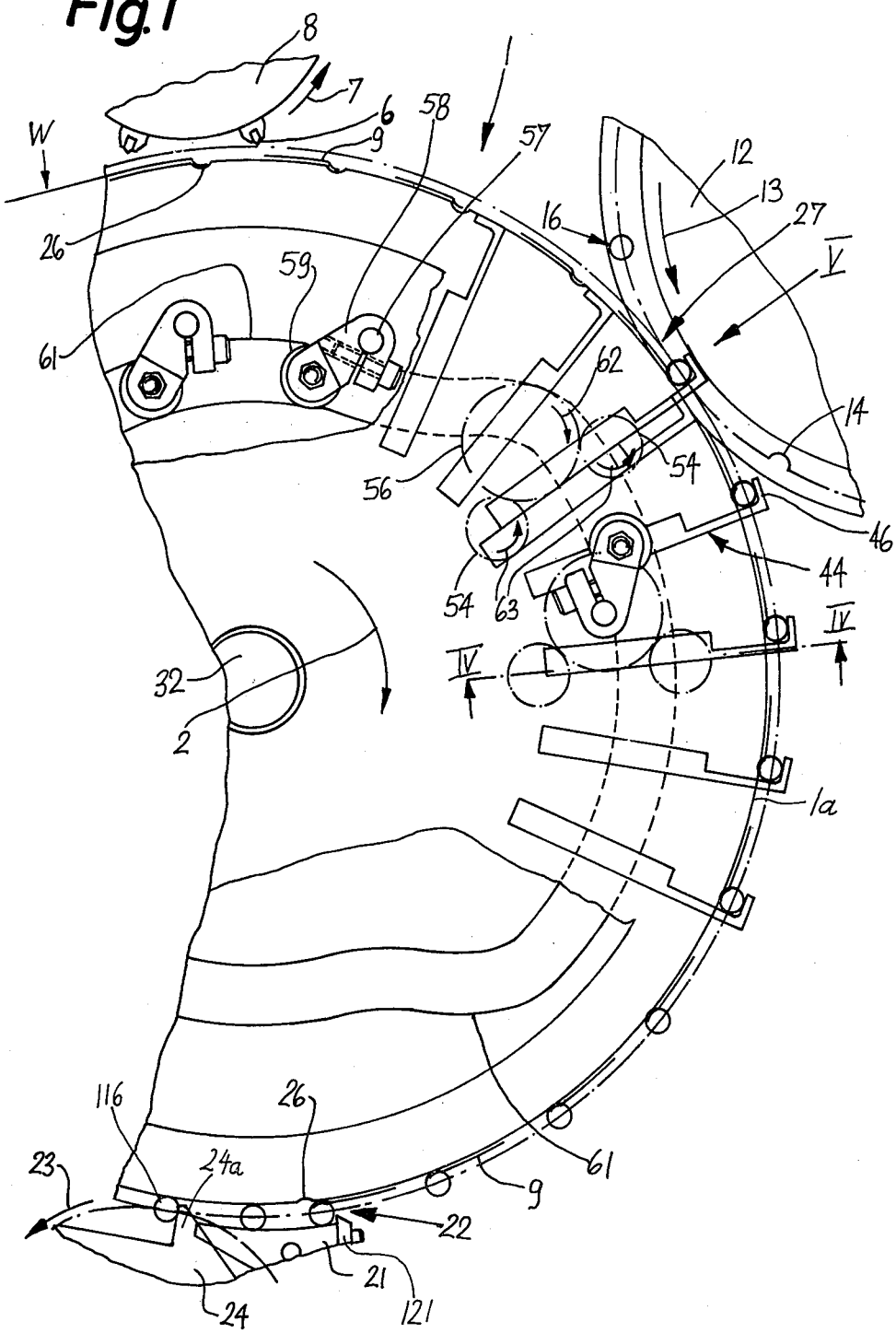
FIG. 1 is a fragmentary partly elevational and partly sectional view of an apparatus which embodies one form of the invention and is incorporated in a filter tipping machine.
Figure 2:
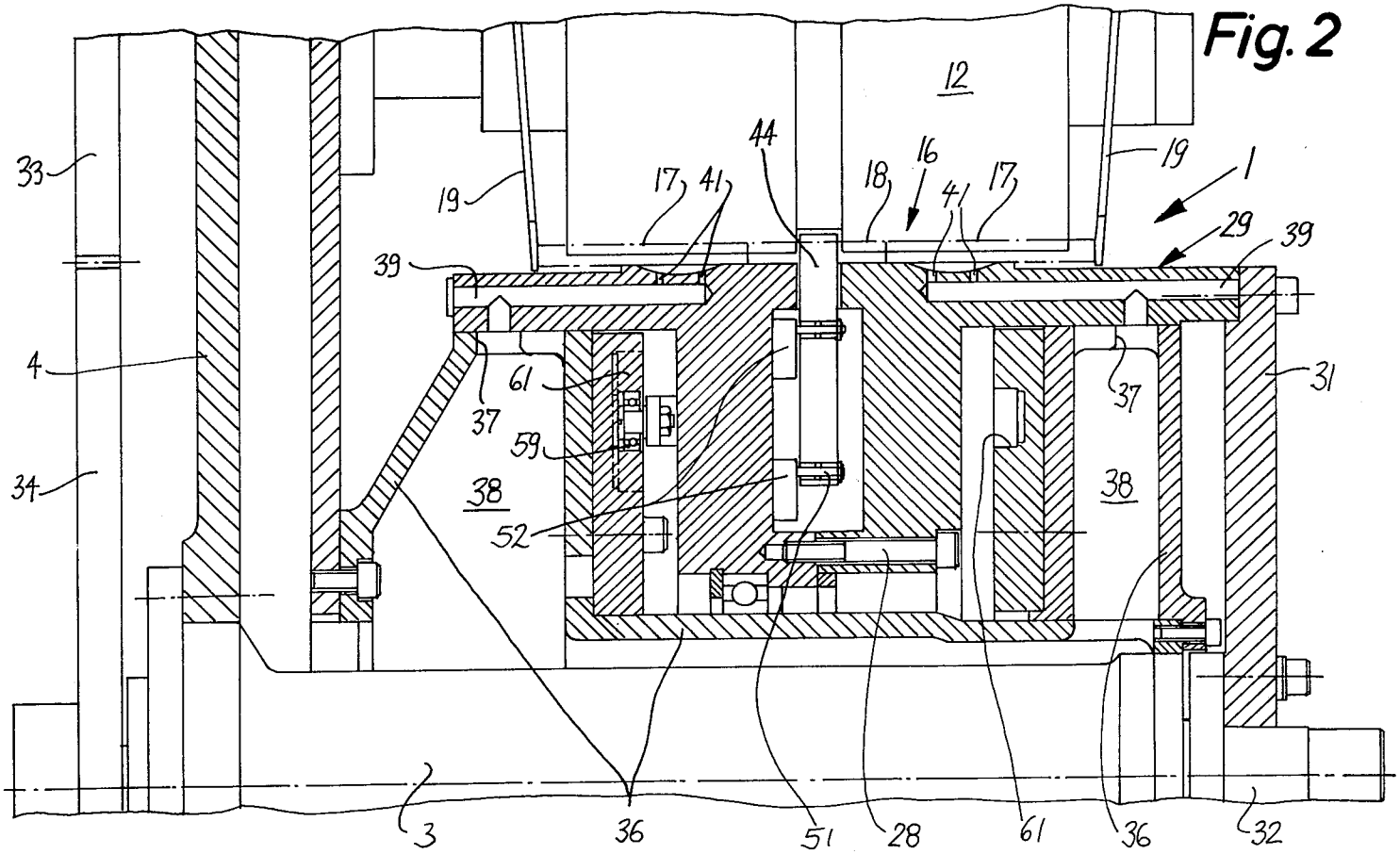
FIG. 2 is a fragmentary axial sectional view of the rolling conveyor and a fragmentary end elevational view of the device which supplies groups of rod-shaped articles to successive axially parallel flutes of the rolling conveyor.

FIGS. 1 and 2 illustrate a rolling conveyor 1 which is a rotary drum-shaped device receiving torque from a drive shaft 32 so as to rotate in a clockwise direction, as viewed in FIG. 1 (note the arrow 2). The drive shaft 32 is rotatably journalled in a stationary sleeve or hub 3 around which the conveyor 1 rotates. The sleeve 3 is affixed to the stationary wall 4 of a housing or frame forming part of a filter tipping machine, e.g., a machine of the type described in the aforementioned commonly owned U.S. Pat. No. 4,280,187 to Reuland et al. whose disclosure is incorporated herein by reference.

The rolling conveyor 1 has a peripheral surface 1*a* which is formed with relatively shallow axially parallel flutes 26 travelling along an arcuate (endless circular) path when the shaft 32 receives torque from the main prime mover of the filter tipping machine by way of a gear train 33, 34 shown in FIG. 2. A first portion of such path is adjacent to a rotary severing device 8 which is a drum driven to rotate in the direction of arrow 7 and having equidistant knives 6 which sever at regular intervals a continuous web W consisting of cigarette paper, imitation cork or other suitable wrapping material adapted to be converted into a succession of discrete uniting bands or patches 9. The speed at which the web W is supplied to the peripheral surface 1*a* is slightly less than the peripheral speed of the rolling conveyor 1 so that the neighboring uniting bands 9 are automatically separated from each other by clearances of predetermined width. In other words, the peripheral surface 1*a* slides with reference to the web W (which is fed to advance lengthwise in the direction of arrow 2) but the uniting bands 9 do not move relative to the surface 1*a* or vice versa. Reference may be had to FIG. 7 of the aforementioned commonly owned U.S. Pat. No. 3,527,234 to Hinzmann whose disclosure is incorporated herein by reference.

The cutting edges of the knives 6 at the periphery of the severing device 8 cooperate with hard-metal inserts 11 (see particularly FIG. 3) which are recessed into the peripheral surface 1*a* of the rolling conveyor 1 and constitute counterknives or anvils cooperating with the knives 6 to sever the web W at regular intervals so that the latter yields a succession of discrete uniting bands 9.

The severing device 8 is followed by a rotary feeding drum 12 which serves to supply groups 16 of coaxial rod-shaped articles to the peripheral surface 1*a* of the rolling conveyor 1 in such a way that each group is in substantially linear contact with a discrete uniting band 9, namely, with the adhesive-coated exposed surface or side of such uniting band. The manner in which one side of the web W is coated with a suitable adhesive (e.g., a wet adhesive or a hotmelt) is described and shown in the aforementioned commonly owned U.S. Pat. No. 4,280,187 to Reuland et al. The drum 12 rotates in the direction of arrow 13 and has axially parallel peripheral flutes 14 which deliver groups 16 to a junction or transfer station 27 where the groups are taken over by the conveyor 1, namely, where the groups adhere to the oncoming uniting bands 9. As can be seen in FIG. 2, each group 16 consists of three coaxial rod-shaped articles, namely, a centrally located filter rod section 18 of double unit length and two plain cigarettes 17 of unit length. The drum 12 can be said to constitute the so-called assembly conveyor of the filter tipping machine and cooperates with two suitably inclined disc-shaped cams 19 which engage the exposed end faces of the plain cigarettes 17 in each group 16 and move (if necessary) the cigarettes 17 axially into actual abutment with the respective end faces of the corresponding filter rod section 18 of double unit length.

The rolling conveyor 1 cooperates with a stationary rolling device 21 to define therewith a rolling gap or channel 22 whose width at most equals but is preferably slightly less than the diameter of a group 16 (it is assumed here that the diameters of filter rod sections 18 of double unit length are identical with or closely approximate the diameters of plain cigarettes 17).

The rolling gap 22 is followed by a rotary aligning wheel 24 having axially parallel peripheral entraining and aligning ribs 24*a* which travel in the direction of arrow 23 when the wheel 24 is in motion. The purpose of the ribs 24*a* is to engage, align and remove successive filter cigarettes 116 of double unit length from the flutes 26 or from the peripheral surface 1*a* of the conveyor 1. Such filter cigarettes 116 are thereupon (a) halved to yield pairs of filter cigarettes of unit length, (b) tested to ascertain the quality of their wrappers, the density of their tobacco-containing ends, the permeability of their wrappers to atmospheric air and/or other characteristics, and (c) transported to storage or directly to a packing machine, not shown.

The speed of the web W, the peripheral speed of the rolling conveyor 1 and the distribution of flutes 26 in the peripheral surface 1*a* of the conveyor 1 are selected in such a way that the leader of each uniting band 9 overlies a flute 26. Furthermore, the movements of the conveyor 1 and feeding drum 12 are synchronized in such a way that the flutes 14 of the drum 12 deliver successive groups 16 into contact with the leaders of the oncoming uniting bands 9, i.e., each group 16 which has been transferred onto the conveyor 1 overlies the respective flute 26 in the peripheral surface 1*a*. In other words, the transfer station 27 receives a group 16 at the exact instant when a flute 26 of the rolling conveyor 1 is immediately adjacent thereto.

Figure 5:
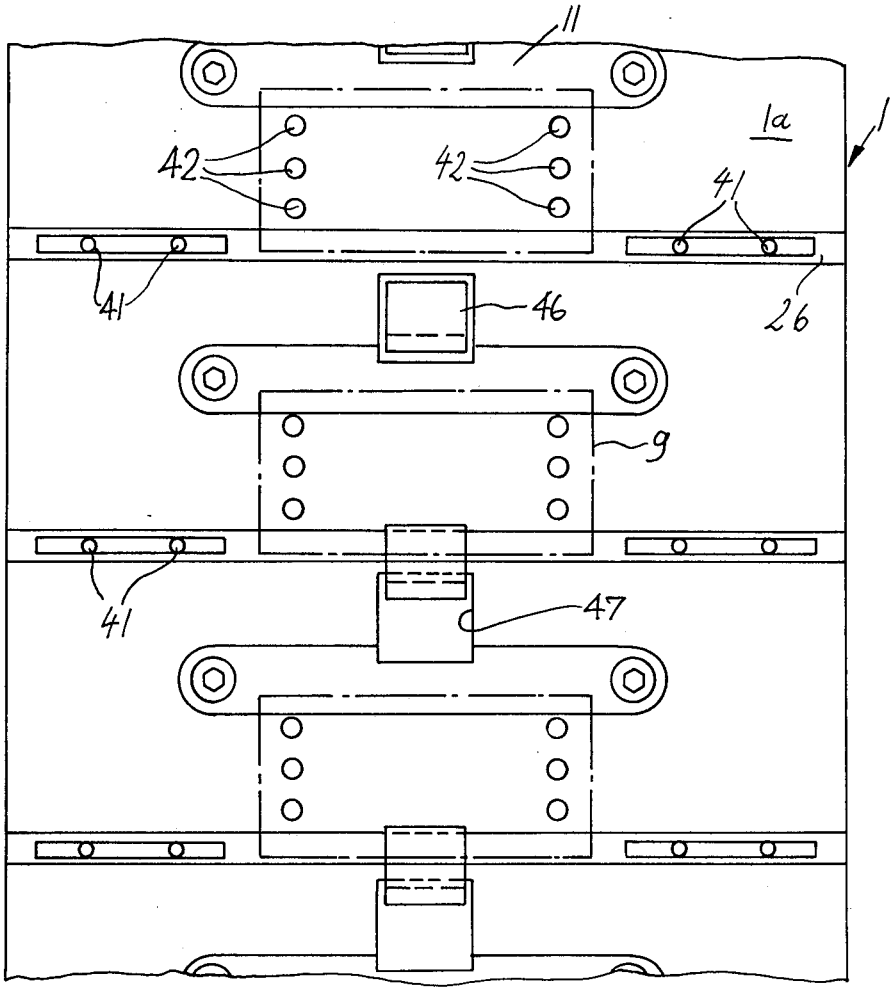
FIG. 5 is an enlarged fragmentary developed view of the rolling conveyor, substantially as seen in the direction of arrow V in FIG. 1.

The conveyor 1 comprises a composite rotor 29 whose sections (preferably two mirror symmetrical sections) are held together by screws 28 or analogous fastener means and which is bolted to a flange 31 rotating with the shaft 32 which is journalled in the aforementioned stationary sleeve or hub 3 for the rotor 29. The rotor 29 turns with reference to a stationary hollow casing or valve plate 36 which is affixed to the sleeve 3 and defines two suction chambers 38 connected with a non-illustrated suction generating device and communicating with slots 37 which, in turn, communicate with certain suction channels 39 of the rotor 29. There are two suction channels 39 for each flute 26, and such flutes communicate with the respective channels by way of suction ports 41 machined into the rotor 29. The length of the slots 37 (as considered in the circumferential direction of the conveyor 1) is selected in such a way that the suction ports 41 communicate with the suction chambers 38 while the respective flutes 26 travel from the transfer station or junction 27 between the conveyor 1 and the feeding drum 12 to the rolling gap 22. The suction ports 41 are formed in those portions of the surfaces bounding the flutes 26 which receive portions of plain cigarettes 17, i.e., the ports 41 ensure that the cigarettes 17 are pneumatically attracted to the conveyor 1 during travel from the station 27 toward the gap 22. The distribution of suction ports 41 in the peripheral surface 1*a* (and more particularly in the surfaces bounding the flutes 26) is best shown in FIG. 5.

Figure 3:
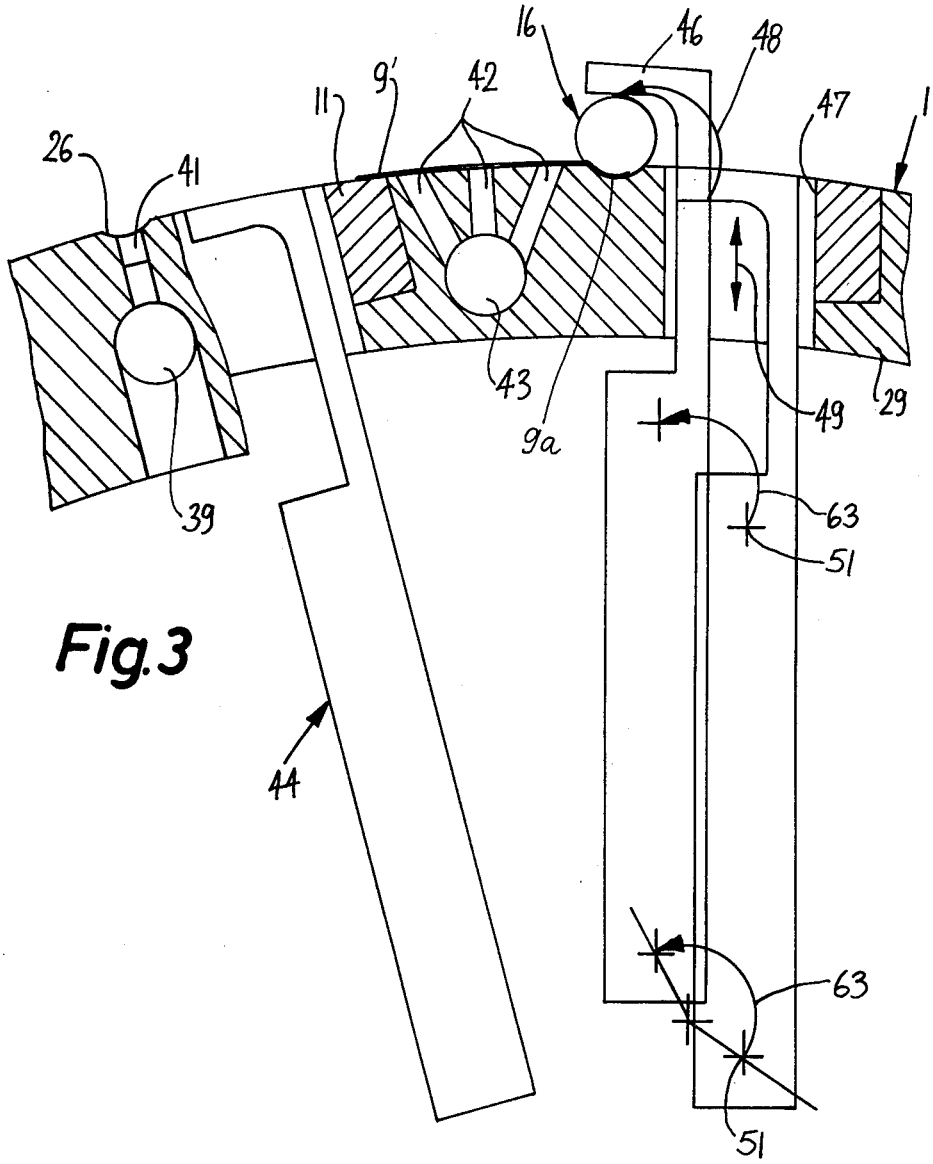
FIG. 3 is a greatly enlarged partial transverse sectional view of the rolling conveyor and an elevational view of two neighboring biasing units, one of the biasing units being shown in retracted position and the other biasing unit being shown in the operative position.

As shown in FIG. 3, the rotor 29 of the rolling conveyor 1 is further formed with channels 43, one for each flute 26, and suction ports 42 which communicate with the respective channels 43 and extend to the peripheral surface 1*a* to attract the uniting bands 9 during travel of such bands from the severing device 8 to the rolling gap 22. The manner in which the channels 43 (of which only one can be seen in FIG. 3) communicate with the suction chambers 38 or directly with one or more suction generating devices is not specifically shown in the drawing. It suffices to say that the suction ports 42 ensure retention of uniting bands 9 at the periphery of the rolling conveyor 1 by pneumatic means during travel of successive uniting bands 9 from the transfer station between the parts 1, 8 to the rolling gap 22. It will be seen that the plain cigarettes 17 are attracted by suction all the way between the station 27 and the gap 22, and that the uniting bands 9 are attracted by suction all the way between the transfer station defined by the parts 1, 8 and the gap 22. This means that the parts 9 and 17 are highly unlikely to leave the peripheral surface 1*a* of the rolling conveyor 1 under the action of gravity and/or centrifugal force even if the conveyor 1 is driven at a speed such as is necessary to enable the filter tipping machine to turn out well in excess of 100 products per second, e.g., in the range of 10,000 products per minute which is nearly twice the output of presently used filter tipping machines.

In order to ensure that the filter rod sections 18 of the groups 16 also remain in optimum positions with reference to the corresponding plain cigarettes 17 and uniting bands 9, the apparatus of the present invention comprises novel and improved biasing means for mechanically urging the sections 18 against the respective uniting bands 9 so that each such section remains in a position of axial alignment with the adjacent plain cigarettes 17 of unit length. The biasing means comprises a discrete biasing unit 44 for each flute 26, and each biasing unit 44 comprises a claw-shaped article-engaging member 46 which is movable along a composite path into and from engagement with the respective filter rod section 18 while such section advances from the station 27 toward the rolling gap 22. The rotor 29 of the rolling conveyor 1 has openings or cutouts 47 through which the article-engaging members 46 (hereinafter called claws for short) can be extended beyond the peripheral surface 1*a* or retracted into the interior of the rotor 29. One of the arcuate paths along which the claws 46 can move into and from engagement with the adjacent filter rod section 18 is indicated by the arrow 48 shown in FIG. 3. The double-headed arrow 49 which is shown in FIG. 3 indicates the directions of reciprocatory movement of the claws 46 with reference to the rotor 29.

Figure 4:
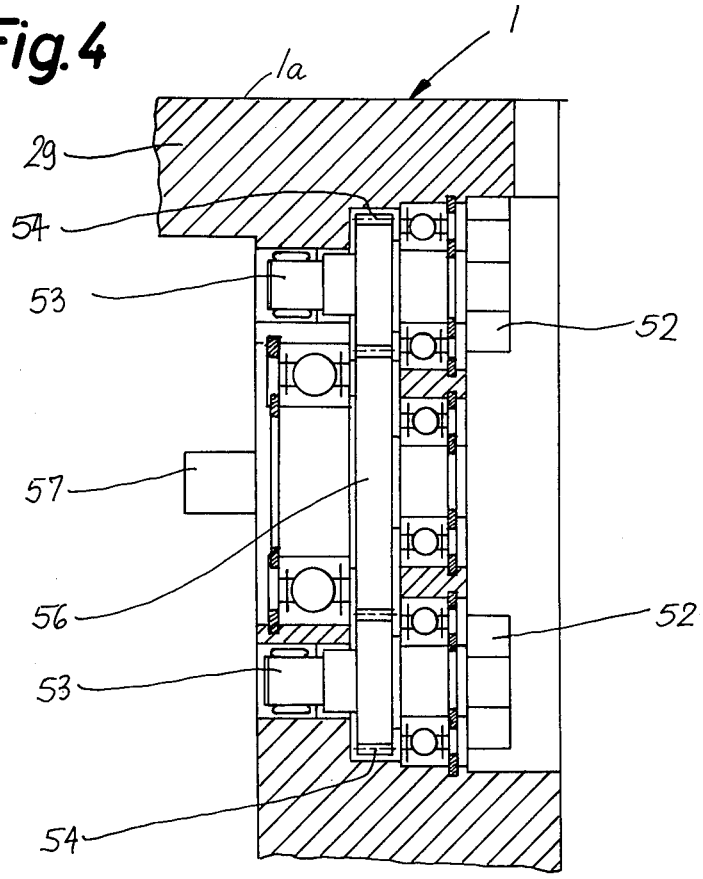
FIG. 4 is an enlarged fragmentary sectional view as seen in the direction of arrows from the line IV—IV of FIG. 1.

The means for synchronizing the movements of the claws 46 with those of the conveyor 1 comprises pairs of disc-shaped guide elements 52 which are rotatable in the same direction and carry eccentrically mounted coupling pins 51 secured to the respective claws 46 (namely, to those portions of the claws 46 which are permanently confined in the interior of the rolling conveyor 1). The discs 52 are connected with shafts 53 (FIG. 4) which carry gears 54 meshing with a driver gear 56 (i.e., there is one gear 56 for each claw 46). Each driver gear 56 is mounted on a discrete shaft 57 which is rigidly connected with a lever 58 carrying a roller follower 59 (see FIG. 1) which extends into a suitably configurated endless cam groove 61 provided in the casing 36 or in a stationary cam member which is affixed to the stationary sleeve 3 or wall 4.

In the illustrated apparatus, there are two stationary cam grooves 61 (see FIG. 2) one at each axial end of the rotor 29, and the shafts 57 alternately extend toward opposite axial ends of the rotor so that one-half of the roller followers 59 extend into one of the cam grooves 61 and the remaining followers 59 extend into the other cam groove. However, it is equally within the purview of the invention to employ a single cam groove 61 and to have all of the shafts 57 extend to one and the same end face of the rotor 29. It will further be noted that several roller followers 59, their levers 58 and other parts which guide and transmit motion to the claws 46 are omitted in FIG. 1 for the sake of clarity.

The operation of the improved apparatus is as follows:

The web W is paid out by a suitable bobbin, reel or analogous source (not shown) and is attracted to the peripheral surface 1*a* of the driven conveyor 1. The means for attracting the leader of the web W to the peripheral surface 1*a* includes the suction ports 42. The leader of the web W is severed at regular intervals by successive knives 6 of the rotary severing device 8 so that the web yields a succession of discrete uniting bands 9 each adhering to the peripheral surface 1*a* in such a way that its leader (as considered in the direction of arrow 2) overlies the nearest shallow flute 26 of the rolling conveyor 1. As explained above, successive uniting bands 9 are automatically separated from one another owing to the fact that the peripheral speed of the rolling conveyor 1 slightly exceeds the speed of lengthwise transport of the web W from the bobbin or reel to the peripheral surface 1*a*. That side of the web W which faces upwardly, as viewed in FIG. 1, is coated (at least in part) with a suitable adhesive paste. Each uniting band 9 is attracted by a set of suction ports 42 so that it cannot change its position with reference to the conveyor 1, i.e., with reference to the corresponding flute 26.

As a uniting band 9 advances toward and past the station 27, it is contacted by the filter rod section 18 of a group 16 which is supplied by the oncoming flute 14 of the feeding drum 12. The flutes 14 are parallel with the flutes 26, and the plain cigarettes 17 of a group 16 which has been transferred onto the rolling conveyor 1 are immediately attracted by the respective suction ports 41 so that they cannot be moved relative to the conveyor 1 while the group 16 advances toward the rolling gap 22. In other words, the uniting bands 9 are attracted by the sets of ports 42 and the plain cigarettes 17 are attracted by the sets of ports 41. The filter rod sections 18 (and the adjacent inner end portions of the plain cigarettes 17) are moved into contact with adhesive which coats the exposed sides of the respective uniting bands 9 so that, under normal circumstances and in the absence of development of excessive centrifugal forces, the filter rod sections 18 should remain in predetermined positions with reference to the surface 1*a* as a result of adhesion to the exposed sides of the uniting bands 9. In order to reliably prevent any and all undesirable shifting or misorientation of filter rod sections 18 with reference to the corresponding uniting bands 9, the claws 46 are caused to move outwardly (arrow 49 in FIG. 3) and thereupon along arcuate paths (arrow 48 in FIG. 3) immediately or shortly after the groups 16 are deposited on the rolling conveyor 1 at the transfer station 27. While it is possible to provide claws of such width as to engage the filter rod sections 18 simultaneously with the corresponding plain cigarettes 17, or to provide additional claws which engage the plain cigarettes 17 while the illustrated claws 46 engage the filter rod sections 18, the arrangement which is shown in the drawing is preferred at this time because the plain cigarettes 17 can be held against any misorientation owing to the fact that their inner end portions adhere to the respective marginal portions of the uniting bands 9 and that they are attracted by the corresponding suction ports 41. The uniting bands 9 are also held against any change of orientation because they are attracted by the suction ports 42. Thus, it normally suffices to provide claws 46 only for the filter rod sections 18, namely, for those rod-shaped articles which cannot be directly attracted by suction because they do not come in direct contact with the peripheral surface 1*a* of the rolling conveyor 1.

A claw 46 which approaches the station 27 begins to move radially outwardly in the respective opening 47. This is due to the fact that the corresponding roller follower 59 then enters an outwardly sloping portion of the respective stationary cam groove 61, i.e., the roller follower 59 begins to track a larger-diameter portion of the cam groove. It will be recalled that the roller followers 59 are provided on levers 58 which are secured to shafts 57 sharing the movements of the rotor 29, i.e., the roller followers 59 travel along the respective cam grooves 61 whenever the rolling conveyor 1 is set in rotary motion. Movement of the roller follower 59 radially outwardly of the rotor 29 entails a clockwise rotation of the corresponding shaft 57 and gear 56 (see the arrow 62 in FIG. 1) and a rotation of the associated gears 54, shafts 53 and discs 52 in the directions indicated in FIG. 1 by arrows 63. This causes the corresponding claw 46 to perform a composite movement having a component in the direction of arrow 49 and taking place along the arc indicated by the arrow 48 in FIG. 3. The result is that the claw 46 emerges from the respective opening 47 of the rotor 29 and moves to a position in which it overlaps the adjacent filter rod section 18 and biases such section against the exposed adhesive-coated surface of the respective uniting band 9. Since the groups 16 overlie the flutes 26 of the conveyor 1, the movement of an exposed claw 46 radially inwardly, i.e., toward the adjacent filter rod section 18, entails a depression of such section into the respective flute 26 with the result that the originally linear contact between the section 18 and the respective uniting band 9 is converted into a surface-to-surface contact with attendant reduction of the likelihood of any misalignment of the section 18 with reference to the uniting band and/or surface 1*a*.

The claws 46 can bias the respective filter rod sections 18 during the entire interval of travel from the station 27 to the rolling gap 22, or only during a portion of such interval, depending on the nature of adhesive which is applied to the uniting bands 9, i.e., on the length of intervals which are required to ensure such setting of adhesive that the filter rod sections 18 cannot change their positions irrespective of whether or not they are actually biased by the claws 46.

When a roller follower 59 advances close to the inlet of the rolling gap 22, it is caused to move along an inwardly sloping portion of the respective cam groove 61 so that the corresponding lever 58 and shaft 57 cause the associated gear 56 to turn in a direction counter to that indicated by the arrow 62 and the gears 54 rotate the discs 52 counter to the directions indicated by the arrows 63. The result is that the claw 46 performs a movement counter to that indicated by the arrow 48 and thereupon radially inwardly into the interior of the rotor 29. In other words, the claw 46 becomes disengaged from the respective filter rod section 18 before the corresponding group 16 enters the rolling gap 22.

The suction ports 41 and 42 are sealed from the respective suction chambers and/or suction generating means immediately or shortly before the corresponding flutes 26 reach the inlet of the rolling gap 22. Therefore, and in view of the selected width of the gap 22, the groups 16 which travel along the concave side of the stationary rolling device 21 and which are expelled from their flutes 26 by a finger 121 are caused to roll about their respective axes with the result that the corresponding uniting bands 9 are coverted into tubes connecting the respective filter rod sections 18 with the adjacent pairs of plain cigarettes 17. Furthermore, the tubes prevent leakage of air into the interior of the resulting filter cigarettes 116 of double unit length in the regions where the plain cigarettes 17 abut against the adjacent end faces of the respective filter rod section 18. During travel through the gap 22, the groups 16 rotate counter to the direction of rotation of the conveyor 1, i.e., in a counterclockwise direction, as viewed in FIG. 1.

When a filter cigarette 116 of double unit length leaves the gap 22, it is engaged by the oncoming rib 24*a* of the aligning wheel 24 and is removed from the periphery of the conveyor 1. To this end, the ribs 24*a* and the adjacent portions of the peripheral surface of the wheel 24 can be formed with suction ports which are connected to a suction generating device when a rib 24*a* approaches the peripheral surface 1*a* of the conveyor 1. The peripheral speed of the wheel 24 normally exceeds the peripheral speed of the conveyor 1 so that the spacing between successive filter cigarettes 116 of double unit length on the wheel 24 normally exceeds the spacing between successive groups 16 on the conveyor 1.

The delivery of successive groups 16 into contact with the leaders of the oncoming uniting bands 9 at the periphery of the conveyor 1 is not critical but highly advantageous and desirable. Thus, and as shown in the lower part of FIG. 1, the formation of cylindrical envelopes or tubes which completely surround the respective filter rod sections 18 and the adjacent end portions of the aligned plain cigarettes 17 is practically guaranteed if the leaders of successive uniting bands 9 overlie the shallow flutes 26 of the conveyor 1 and the groups 16 adhere to such leaders during entry into the rolling gap 22. Moreover, and if the groups 16 overlie the adjacent flutes 26, they are more likely to move into surface-to-surface contact with the leaders of the respective uniting bands 9 when the claws 46 are caused to assume the operative positions corresponding to that of the right-hand claw 46 shown in FIG. 3. FIG. 3 shows that the leader 9*a* of the uniting band marked 9′ is in surface-to-surface contact with the respective group 16. Such surface-to-surface contact can be established already during transfer of groups 16 from the drum 12 onto the conveyor 1 or shortly thereafter, namely, during movement of the respective claw 46 to its operative position.

It is also within the purview of the invention to provide the apparatus with biasing means which includes biasing units movable in synchronism with but independently of the rolling conveyor 1. For example, the biasing units could be carried by a discrete rotary conveyor coaxial with and adjacent to the rolling conveyor 1, and such discrete conveyor could be provided with means (such as the cam grooves 61) for initiating movements of the claws 46 to their operative or retracted positions when the corresponding flutes 26 of the rolling conveyor 1 reach predetermined angular positions. The illustrated apparatus is preferred at this time because the biasing units 44 can be accommodated in the interior of the rolling conveyor 1, i.e., such biasing units need not occupy any additional space and, therefore, the improved apparatus can be readily installed in existing filter tipping machines with a minimum of modifications in the design and mode of operation of such machines.

An important advantage of the improved method and apparatus is that each and every component of each and every filter cigarette 116 of double unit length is positively held at the periphery of the rolling conveyor 1 from the locus of delivery (i.e., from the transfer station between the conveyor 1 and the severing device 8 or the station 27) and all the way or nearly all the way to the inlet of the rolling gap 22. Certain components are held by pneumatic means and certain components are held by mechanical means (as stated above, it is possible to hold at least some of the components by mechanical as well as by pneumatic means, e.g., by providing biasing claws for the plain cigarettes 17). The length of intervals during which the claws 46 are held in contact with and bias the respective filter rod sections 18 depends on the nature of adhesive which coats the outer sides of the uniting bands 9, on the distance between the station 27 and the gap 22, and on the peripheral speed of the rolling conveyor 1. The length of such intervals can further depend on the presence or absence of means (such as a heater) for promoting the setting of adhesive on the uniting bands 9 which are attracted to the peripheral surface 1*a* of the rolling conveyor 1. In certain instances, the claws 46 will be merely required to bias the respective sections 18 for very short intervals of time in order to increase the area of contact between each section 18 and the respective uniting band 9 so that the sections 18 thereupon adhere to the respective uniting bands exclusively as a result of attraction which is established and maintained by the adhesive at the outer sides of the uniting bands. All that counts is to ensure that each and every component of each filter cigarette 116 of double unit length will retain its optimum orientation with reference to the other component or components and/or with reference to the rolling conveyor 1 during travel along the path which is defined by the peripheral surface 1*a* of the conveyor 1. Thus, each and every component should withstand the "head wind" or the "tail wind" as well as the action of gravity and/or centrifugal force irrespective of the selected peripheral speed of the rolling conveyor 1.

Another important advantage of the improved method and apparatus is that the orientation of various components of the filter cigarettes 116 of double unit length with reference to each other and/or with reference to the conveyor 1 is less dependent on the quality and/or condition of adhesive which coats the outer sides of the uniting bands 9. This is due to the fact that the components of the filter cigarettes 116 are "chained" or "locked" to the peripheral surface 1*a* during travel toward the rolling gap 22 so that they must retain the positions which are best suited for the making of high-quality smokers' products. Moreover, the filter rod sections 18 are not likely to fly away under the action of gravity and/or centrifugal force, even at a very high peripheral speed of the rolling conveyor 1, when the transfer of certain groups 16 onto the conveyor 1 is effected in such a way that the extent of contact between a group 16 and the adhesive-coated exposed side of the respective uniting band 9 is less than satisfactory. The claws 46 automatically compensate for such potential defects in the transfer of groups 16 onto the rolling conveyor 1. The improved method and apparatus can be respectively resorted to and installed in existing filter tipping machines (which turn out an average of 100 smokers' products per second) to further enhance the reliability and safety of such machines, or in machines which are designed to turn out well in excess of 6000 products per minute.

The suction ports 41 can be omitted if the conveyor 1 is provided or combined with suitable shrouds which mechanically hold the plain cigarettes 17 in their respective flutes 26. Alternatively, such shrouds can be used in addition to the suction ports 41. The aforementioned mechanical shrouds can replace the biasing claws 46 but the claws are preferred because they move with the conveyor 1 and, therefore, they are incapable of initiating the rolling of rod-shaped articles about their respective axes before such articles reach the rolling gap 22.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of joining groups of coaxial rod-shaped articles by means of adhesive-coated uniting bands at a rolling station, particularly of joining groups of articles which constitute or form part of smokers' products, comprising the steps of subdividing a web of wrapping material into a series of discrete uniting bands; conveying the uniting bands of said series in a predetermined direction and along a predetermined path toward the rolling station; contacting successive uniting bands in said path by discrete groups of articles at a location which is spaced apart from the rolling station; biasing at least one article of each group against the respective uniting band during transport toward the rolling station; and rolling successive groups about their respective axes at the rolling station so that the respective uniting bands are convoluted around such groups of articles.

2. The method as defined in claim 1 of joining groups of articles each having a predetermined diameter, wherein said path is an arcuate path and said rolling step includes transporting the groups and the associated uniting bands through a gap whose width is at least slightly less than said predetermined diameter.

3. The method of claim 1, further comprising the step of confining said uniting bands to movement along said path and toward the rolling station independently of said biasing step.

4. The method of claim 3, wherein said confining step includes pneumatically holding the uniting bands in said path.

5. The method of claim 3, wherein said confining step comprises attracting the uniting bands into said path by suction.

6. The method of claim 1, wherein said biasing step includes mechanically urging at least one article of each group against the respective band in said path.

7. Apparatus for joining groups of coaxial rod-shaped articles by means of adhesive-coated uniting bands, particularly for joining groups of articles which constitute or form part of smokers' products, comprising a conveyor arranged to travel in a predetermined direction and having a supporting surface; means for supplying to said conveyor uniting bands and groups of articles so that each band overlies a portion of said surface and the corresponding group overlies the band; a rolling device located downstream of said supplying means, adjacent to the path of movement of groups in said direction and defining with said surface a gap having a width such that successive groups are rotated about their respective axes during travel through said gap with attendant convolution of the associated uniting bands therearound; and means for biasing at least one article of each group against the respective uniting band during transport of groups toward said gap.

8. The apparatus of claim 7, wherein said biasing means comprises a plurality of biasing units and means for moving said biasing units in synchronism with said conveyor.

9. The apparatus of claim 7, wherein said conveyor is a rotary conveyor and said surface is the peripheral surface of the rotary conveyor.

10. Apparatus for joining groups of coaxial rod-shaped articles by means of adhesive-coated uniting bands, particularly for joining groups of articles which constitute or form part of smokers' products, comprising a conveyor arranged to travel in a predetermined direction and having a supporting surface provided with a plurality of equidistant flutes extending transversely of said direction; means for supplying to said conveyor uniting bands and groups of articles so that each band overlies a portion of said surface and the corresponding group overlies the band, each of said uniting bands having a leader, as considered in said direction, and said supplying means being arranged to supply uniting bands in such positions that the leader of each uniting band overlies one of said flutes; a rolling device adjacent to the path of movement of groups in said direction and defining with said surface a gap having a width such that successive groups are rotated about their respective axes during travel through said gap with attendant convolution of the associated uniting bands therearound; and means for biasing at least one article of each group against the respective uniting band during the transport of groups toward said gap.

11. The apparatus of claim 10, wherein said supplying means comprises a first device which is arranged to furnish uniting bands and a second device, located downstream of said first device, as considered in said direction, and arranged to deliver groups of coaxial articles so that each group overlies one of said flutes.

12. Apparatus for joining groups of coaxial rod-shaped articles by means of adhesive-coated uniting bands, particularly for joining groups of articles which constitute or form part of smokers' products, comprising a conveyor arranged to travel in a predetermined direction and having a supporting surface; means for supplying to said conveyor uniting bands and groups of articles so that each band overlies a portion of said surface and the corresponding group overlies the band; a rolling device adjacent to the path of movement of groups in said direction and defining with said surface a gap having a width such that successive groups are rotated about their respective axes during travel through said gap with attendant convolution of the associated uniting bands therearound; and means for biasing at least one article of each group against the respective uniting band during transport of groups toward said gap, said biasing means comprising a plurality of discrete biasing units each having a member installed in said conveyor and movable between a retracted position in the interior of said conveyor and an extended position of engagement with an article of the respective group of articles on said surface.

13. The apparatus of claim 12, wherein said members are claws.

14. Apparatus for joining groups of coaxial rod-shaped articles by means of adhesive-coated uniting bands, particularly for joining groups of articles which constitute or form part of smokers' products, comprising a conveyor arranged to travel in a predetermined direction and having a supporting surface; means for supplying to said conveyor uniting bands and groups of articles so that each band overlies a portion of said surface and the corresponding group overlies the band; a rolling device adjacent to the path of movement of groups in said direction and defining with said surface a gap having a width such that successive groups are rotated about their respective axes during travel through said gap with attendant convolution of the associated uniting bands therearound; and means for biasing at least one article of each group against the respective uniting band during transport of groups toward said gap, said biasing means comprising a plurality of discrete biasing units installed in said conveyor, said conveyor having openings provided in said surface, one for each of said units, said biasing means further comprising means for moving said units into the interior of said conveyor by way of the respective openings and out of the conveyor by way of the respective openings and into engagement with the articles of the respective groups.

15. Apparatus for joining groups of coaxial rod-shaped articles by means of adhesive-coated uniting bands, particularly for joining groups of articles which constitute or form part of smokers' products, comprising a conveyor arranged to travel in a predetermined direction and having supporting surface; means for supplying to said conveyor uniting bands and groups of articles so that each band overlies a portion of said surface and the corresponding group overlies the band; a rolling device adjacent to the path of movement of groups in said direction and defining with said surface a gap having a width such that successive groups are rotated about their respective axes during travel through said gap with attendant convolution of the associated uniting bands therearound; and means for biasing at least one article of each group against the respective uniting band during transport of groups toward said gap, said biasing means comprising a plurality of discrete biasing units and means for moving said units with reference to the groups of articles on said surface, said moving means including means for imparting to said units movements along arcuate paths.

16. The apparatus of claim 16, wherein said moving means comprises a pair of rotary discs for each of said units and means for eccentrically coupling each unit to the respective discs.

17. The apparatus of claim 16, wherein said moving means further comprises means for rotating said pairs of discs in the same direction.

18. The apparatus of claim 17, wherein said rotating means comprises a pair of first gears for each of said units and each coaxial with one of the respective discs, a plurality of second gears, one for each of said pairs of first gears and each mating with the respective first gears, and means for rotating said second gears back and forth through angles of preselected magnitude.

19. The apparatus of claim 18, wherein said means for rotating said second gears comprises at least one stationary cam and follower means operatively connected with said second gears and tracking said cam.

20. The apparatus of claim 19, wherein said cam has an endless cam groove and said follower means extend into said groove.

* * * * *